US011953282B2

(12) United States Patent
Kung et al.

(10) Patent No.: US 11,953,282 B2
(45) Date of Patent: Apr. 9, 2024

(54) SIMULATED SHAKING BULLET CHAIN TYPE TOY GUN

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 190 days.

(21) Appl. No.: 17/707,101

(22) Filed: Mar. 29, 2022

(65) Prior Publication Data

US 2023/0235986 A1 Jul. 27, 2023

(30) Foreign Application Priority Data

Jan. 26, 2022 (TW) ..... 111201057

(51) Int. Cl.
*F41B 7/08* (2006.01)
*A63H 33/30* (2006.01)
*F41A 33/00* (2006.01)

(52) U.S. Cl.
CPC ..... *F41A 33/00* (2013.01); *A63H 33/30* (2013.01); *F41B 7/08* (2013.01)

(58) Field of Classification Search
CPC .. F41B 7/08; F41B 11/50; F41B 11/89; F41A 9/76; F41A 9/79; F41A 33/00; F41A 33/06; A63H 33/30
USPC ..... 446/405, 473; 124/1, 41.1, 45, 51.1, 80, 124/82; 42/54, 57; 89/33.2
See application file for complete search history.

(56) References Cited

U.S. PATENT DOCUMENTS 2,405,341 A * 8/1946 Binks ..... F41C 3/08 446/406
3,369,535 A * 2/1968 Bonanno ..... F41B 7/006 124/31
3,559,630 A * 2/1971 Frye ..... F41C 3/08 124/39
4,696,654 A * 9/1987 Welch ..... A63H 5/04 446/268
5,244,431 A * 9/1993 D'Andrade ..... A63H 5/04 434/18
5,283,970 A * 2/1994 Aigner ..... A63H 5/04 362/112
5,660,159 A * 8/1997 Clayton ..... F41B 11/646 124/66
6,695,676 B2 * 2/2004 Blake ..... A63H 5/04 446/475

(Continued)

*Primary Examiner* — Alexander R Niconovich
(74) *Attorney, Agent, or Firm* — Chun-Ming Shih; HOLS IPR SERVICES

(57) ABSTRACT

A simulated shaking bullet chain type toy gun equipped with a bullet chain is provided. The toy gun includes a gun body, an actuated member, and a bolt assembly and a reciprocating assembly both reciprocatingly disposed in the gun body. The reciprocating assembly is linked to the bolt assembly and has a trigger portion reciprocating with the reciprocating assembly to produce a moving path. The actuated member is installed in the gun body and located on the moving path, and connected to the bullet chain. The reciprocating assembly reciprocates to trigger the actuated member by the trigger portion, and the actuated member links the bullet chain to shake, so as to achieve a high degree of simulation of the shaking effect of the bullet chain.

11 Claims, 10 Drawing Sheets

(56) References Cited

U.S. PATENT DOCUMENTS

| | | | | |
|---|---|---|---|---|
| 8,127,753 | B1 * | 3/2012 | Brooks | F41B 11/646 124/66 |
| 8,146,281 | B2 * | 4/2012 | Zimmerman | F41B 11/89 89/34 |
| 8,387,605 | B2 * | 3/2013 | Brown | F41B 7/08 124/66 |
| 8,585,407 | B2 * | 11/2013 | Hu | F41B 7/003 434/18 |
| 8,662,063 | B2 * | 3/2014 | Hu | F41B 11/646 124/66 |
| 8,800,541 | B2 * | 8/2014 | Hu | F41A 33/06 124/66 |
| 8,875,689 | B2 * | 11/2014 | Chor-Ming | F41B 11/54 124/56 |
| 10,989,493 | B1 * | 4/2021 | Kung | F41A 33/06 |
| 2009/0101130 | A1 * | 4/2009 | Hu | F41B 7/003 124/80 |
| 2009/0127758 | A1 * | 5/2009 | Hu | F41B 7/003 267/167 |
| 2012/0138038 | A1 * | 6/2012 | Lee | F41A 33/06 124/80 |
| 2023/0266092 | A1 * | 8/2023 | Kung | F41B 11/55 446/473 |

* cited by examiner

SIMULATED SHAKING BULLET CHAIN TYPE TOY GUN

BACKGROUND OF THE DISCLOSURE

Technical Field

The technical field relates to a toy gun with a bullet chain, and more particularly relates to a simulated shaking bullet chain type toy gun.

Description of Related Art

In general, toy guns usually use plastic pellets or paintballs as bullets, and these plastic pellets or paintballs need to be stored in a magazine and hidden, and thus players can only see the gun from the outside, but not the bullets, and the degree of simulation is limited.

For this reason, there are toy guns equipped with a bullet chain, but the related-art toy guns only achieve a fake appearance of the bullet chain and fail to simulate the shaking of the bullet chain of a real gun during shooting. In other words, the related-art toy guns do not have the simulated shaking effect. As a result, players lose their willingness to buy such toy guns since the bullet chain do not shake when shooting.

In view of the aforementioned drawbacks, the inventor proposes this disclosure based on his expert knowledge and elaborate researches to overcome the drawbacks of the related art.

SUMMARY OF THE DISCLOSURE

It is a primary objective of this disclosure to provide a simulated shaking bullet chain type toy gun.

To achieve the aforementioned objective, this disclosure discloses a simulated shaking bullet chain type toy gun, equipped with a bullet chain and including: a gun body; a bolt assembly, reciprocatingly disposed in the gun body; a reciprocating assembly, reciprocatingly disposed in the gun body, and linked with the bolt assembly, and having a trigger portion reciprocating with the reciprocating assembly to produce a moving path; and an actuated member, installed to the gun body, located on the moving path, and connected to the bullet chain. The reciprocating assembly reciprocates to trigger the actuated member by the trigger portion, and the actuated member links the bullet chain to shake.

Compared with the related art, this disclosure has the following effect. By triggering the deflection of the actuated member, the bullet chain is linked to shake, so that a high degree of simulation of the shaking effect of the bullet chain may be achieved.

BRIEF DESCRIPTION OF THE DRAWINGS

The technical characteristics of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
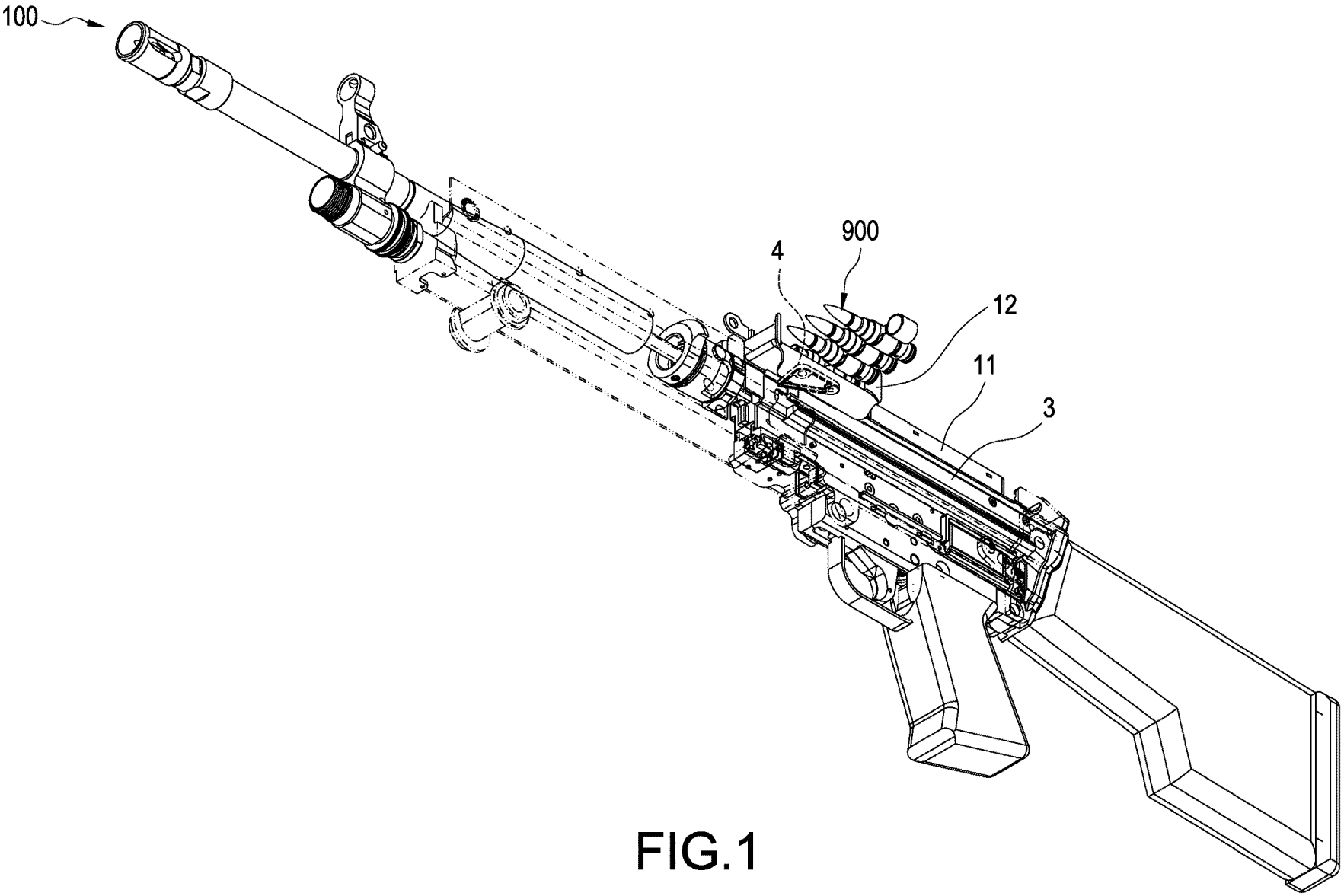
FIG. 1 is a perspective view of a toy gun and a bullet chain of this disclosure.

With reference to FIG. 1 for a simulated shaking bullet chain type toy gun of this disclosure, the toy gun is equipped with a bullet chain 900, and the simulated shaking bullet chain type toy gun of this disclosure (hereinafter referred to as "toy gun" 100) includes: a gun body 1, a bolt assembly 2, a reciprocating assembly 3 and an actuated member 4, and in some embodiments, further includes a passive elastic element 5. The gun body 1 has a gun body upper frame 11. The bolt assembly 2 and the reciprocating assembly 3 are reciprocatingly disposed in the gun body 1, and the reciprocating assembly 3 is linked to the bolt assembly 2 (the detailed description is omitted here for brevity). The bullet chain 900 as shown in FIGS. 5 and 8 includes a chain and a plurality of bullets (which are not labeled in the figures).

Figure 8:
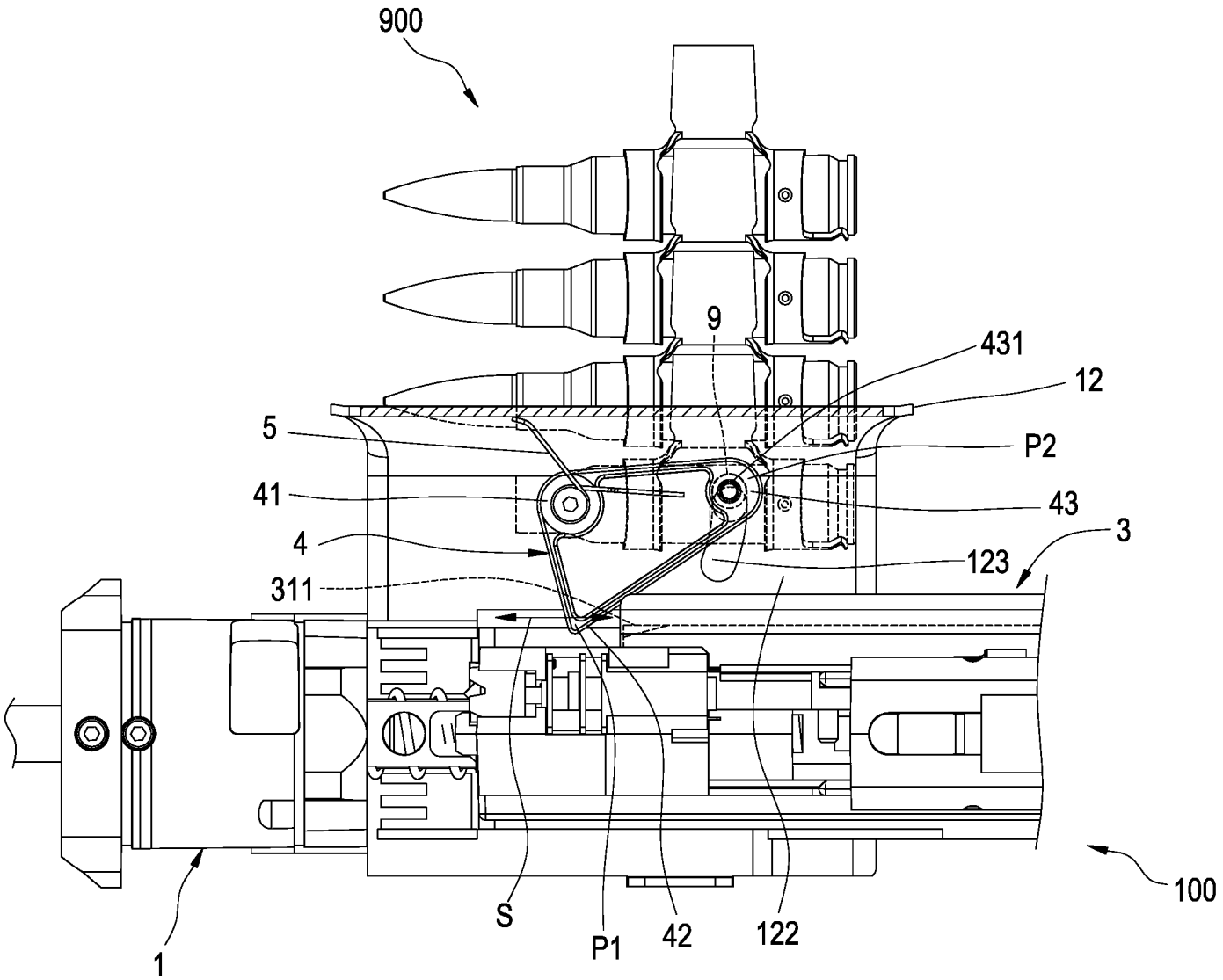
FIG. 8 is a bottom view of FIG. 7.
Figure 9:
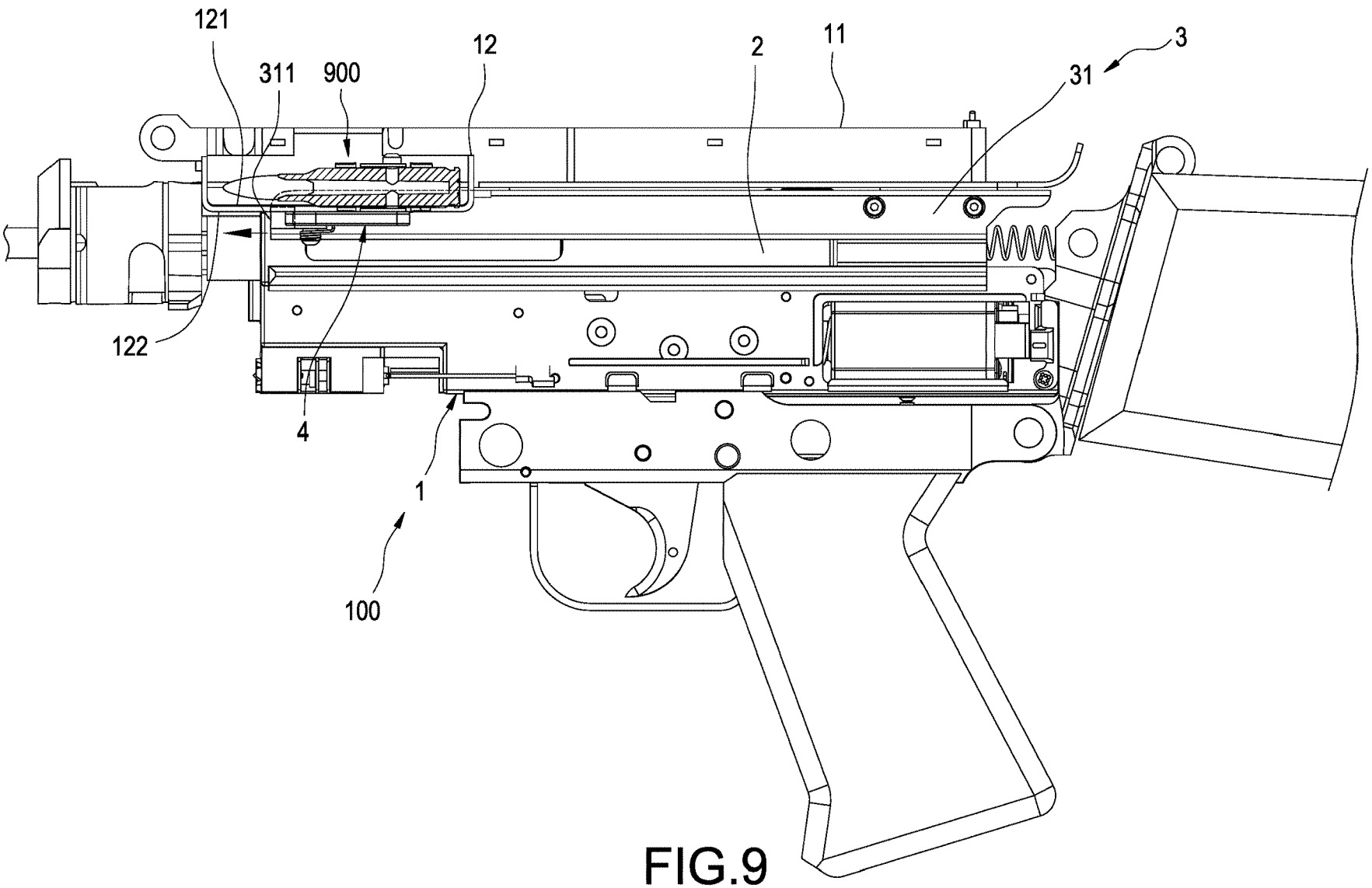
FIG. 9 is a partial cross-sectional view of an ammunition feed bracket of a toy gun of this disclosure (after the toy gun is triggered)

In FIGS. 1 to 6, the reciprocating assembly 3 has a trigger portion 311 reciprocating with the reciprocating assembly 3 to produce a moving path S (as shown in FIG. 8), so that the trigger portion 311 may trigger other objects during the reciprocating process.

Figure 2:
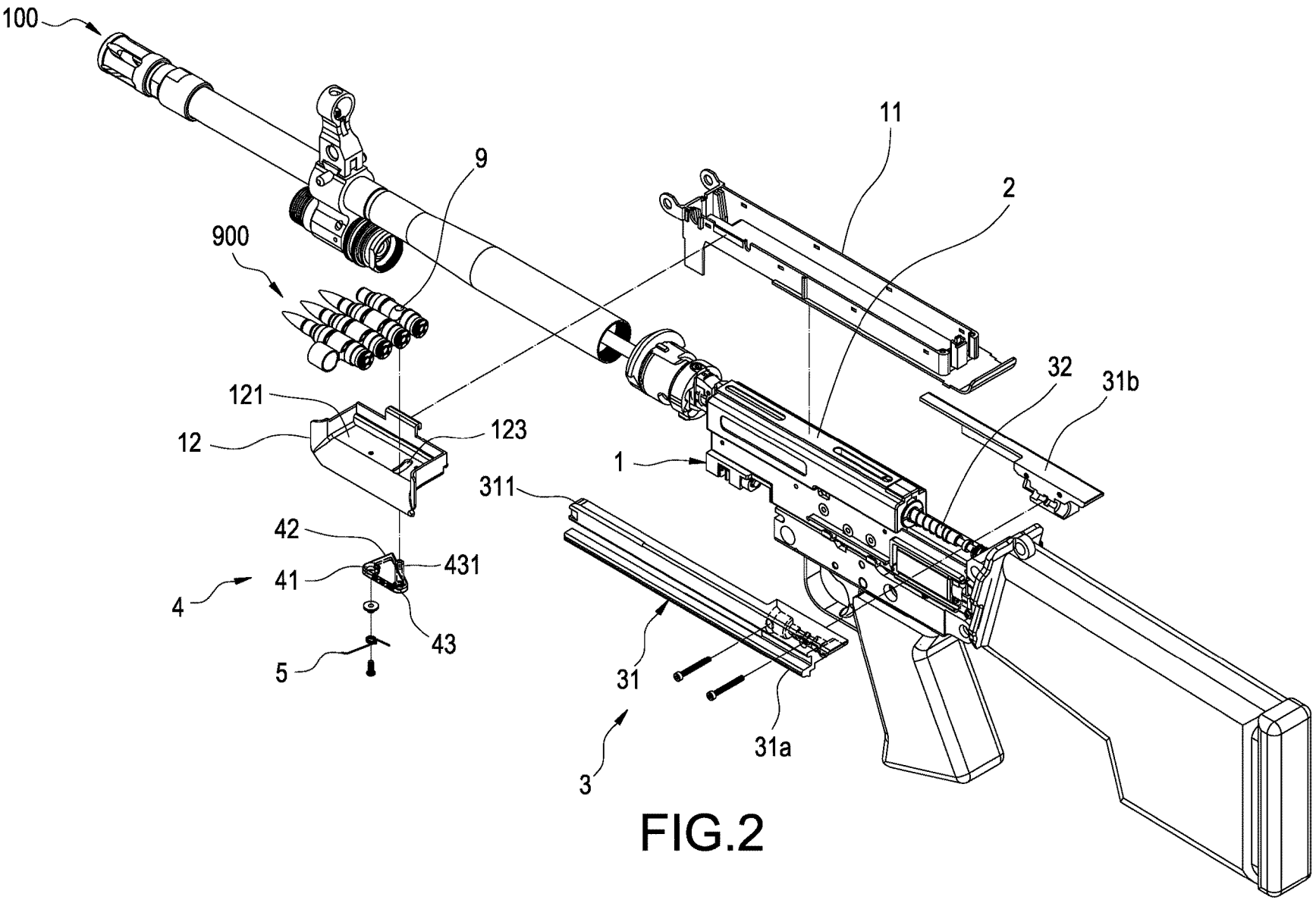
FIG. 2 is an exploded view of a toy gun of this disclosure.
Figure 6:
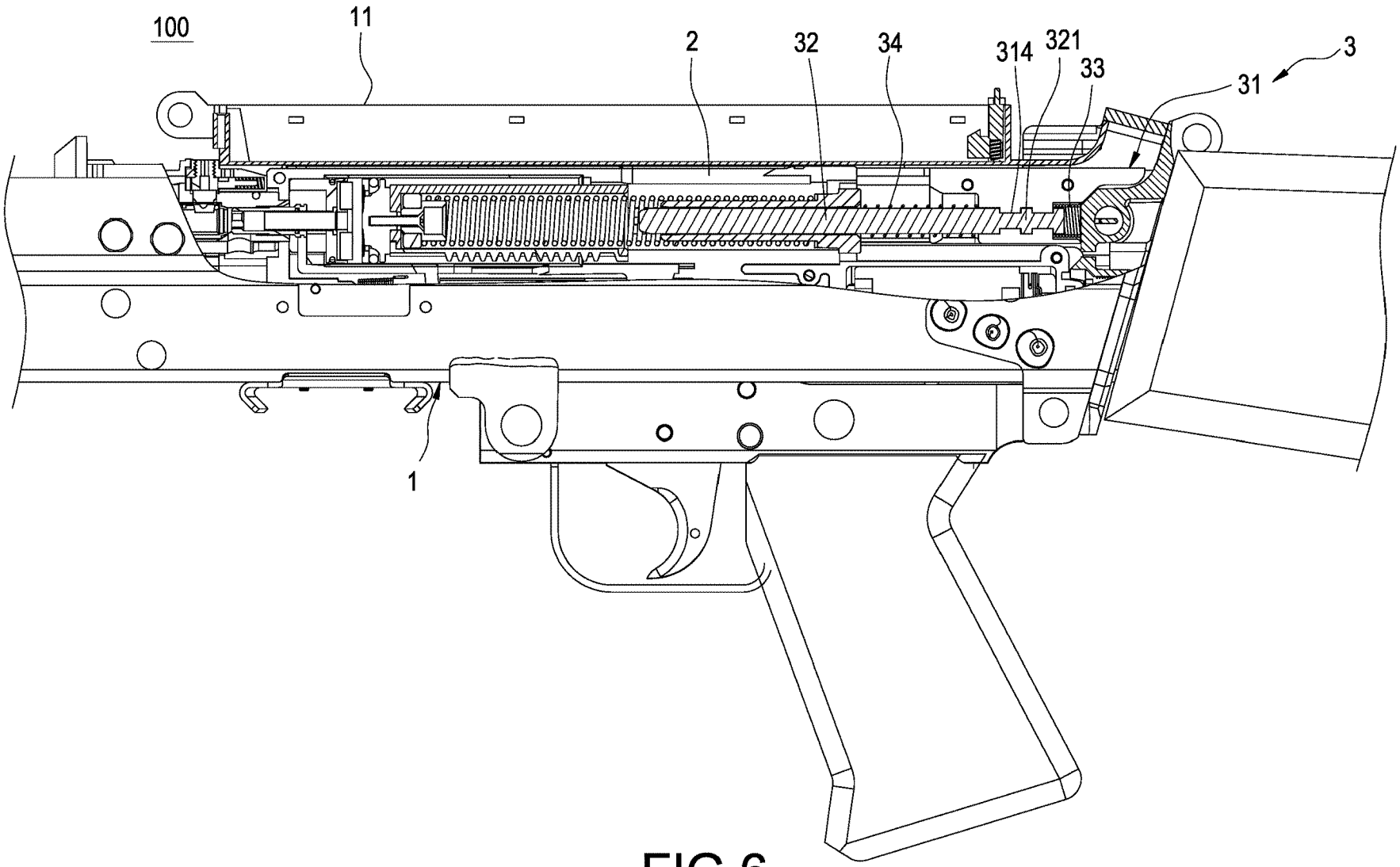
FIG. 6 is a partial cross-sectional view of a toy gun of this disclosure.

Specifically, the reciprocating assembly 3 includes a moving main body 31, an actuating rod 32, a first actuating elastic element 33 and a second actuating elastic element 34. The moving main body 31 is slidably connected to the gun body 1, and the moving main body 31 further contains a fixing portion 314. The actuating rod 32 is inserted (plugged) into the moving main body 31, and the actuating rod 32 has an end formed with a fixing section 321 corresponding to the fixing portion 314 and the other end is inserted into an end of the bolt assembly 2 as shown in FIGS. 2 and 6, and the fixing section 321 is fixed to the fixing portion 314 and partially exposed from the fixing portion 314 as shown in FIG. 6. The first actuating elastic element 33 sheathes the partially exposed portion of the fixing section 321 and elastically supported between the moving main body 31 and the gun body 1 as shown in FIG. 6. The second actuating elastic element 34 sheathes the actuating rod 32 and is elastically supported between the moving main body 31 and the end of the bolt assembly 2 as shown in FIG. 6.

Figure 3:
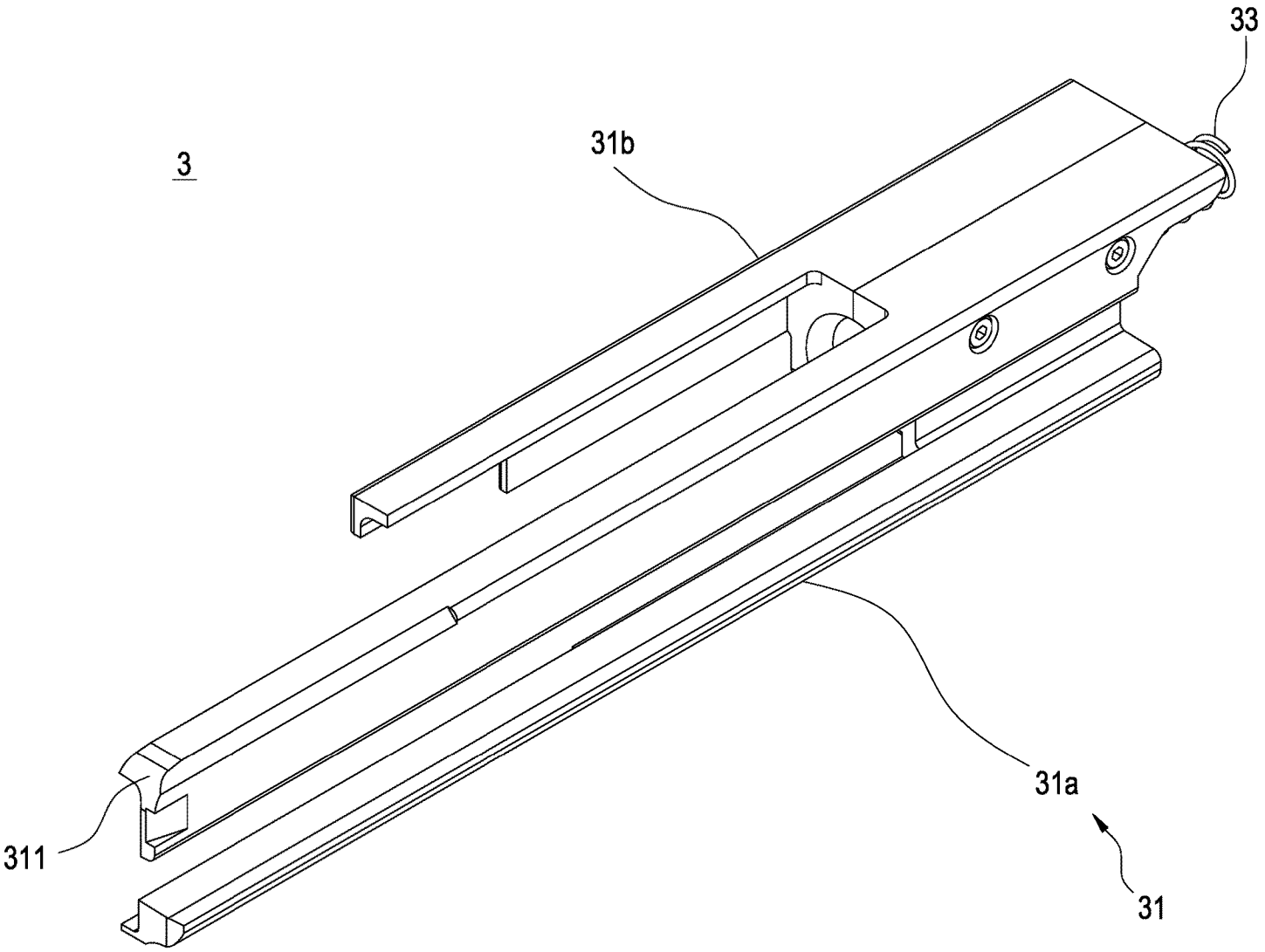
FIG. 3 is a perspective view of a reciprocating assembly of this disclosure.
Figure 4:
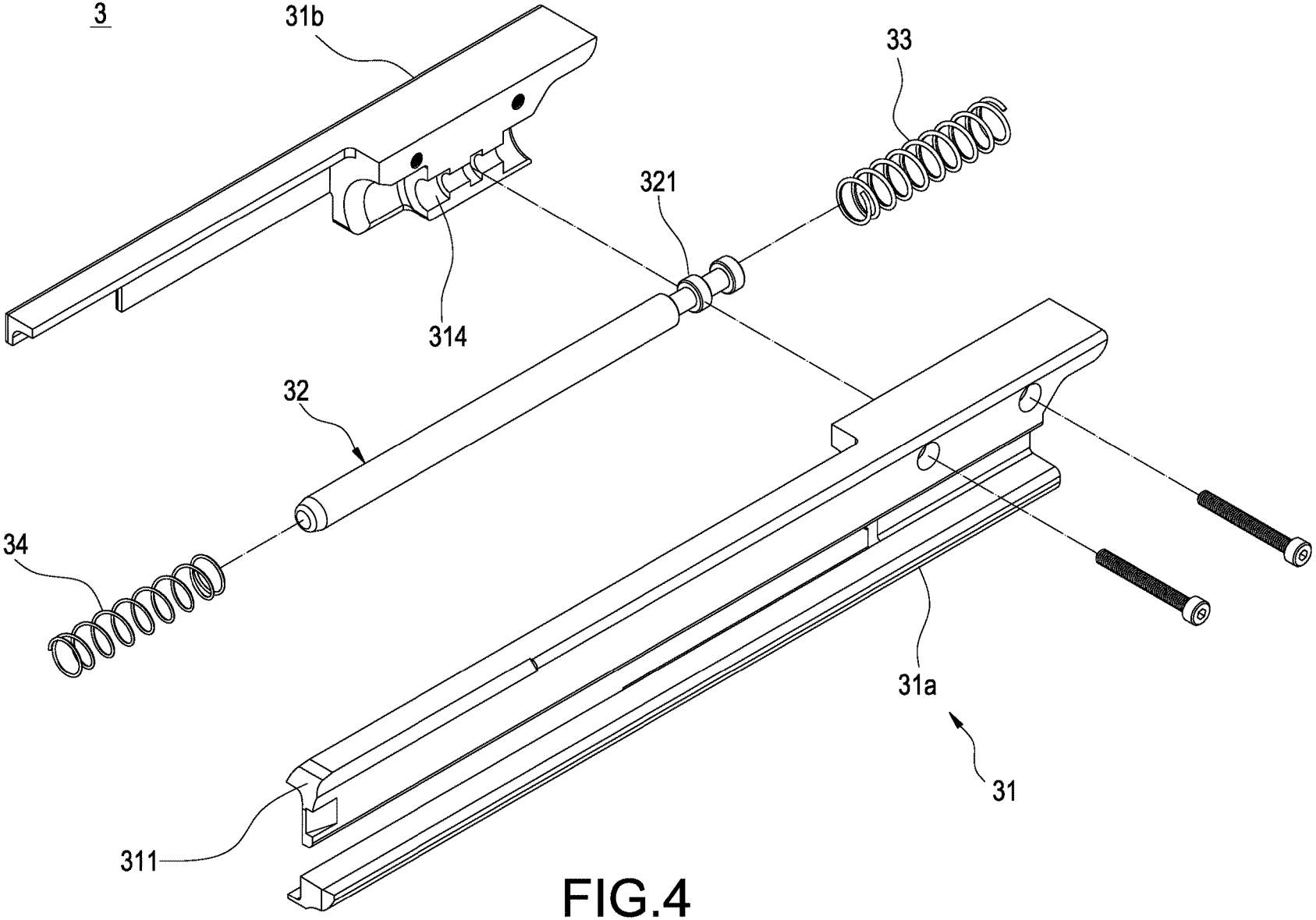
FIG. 4 is an exploded view of a reciprocating assembly of this disclosure.
Figure 5:
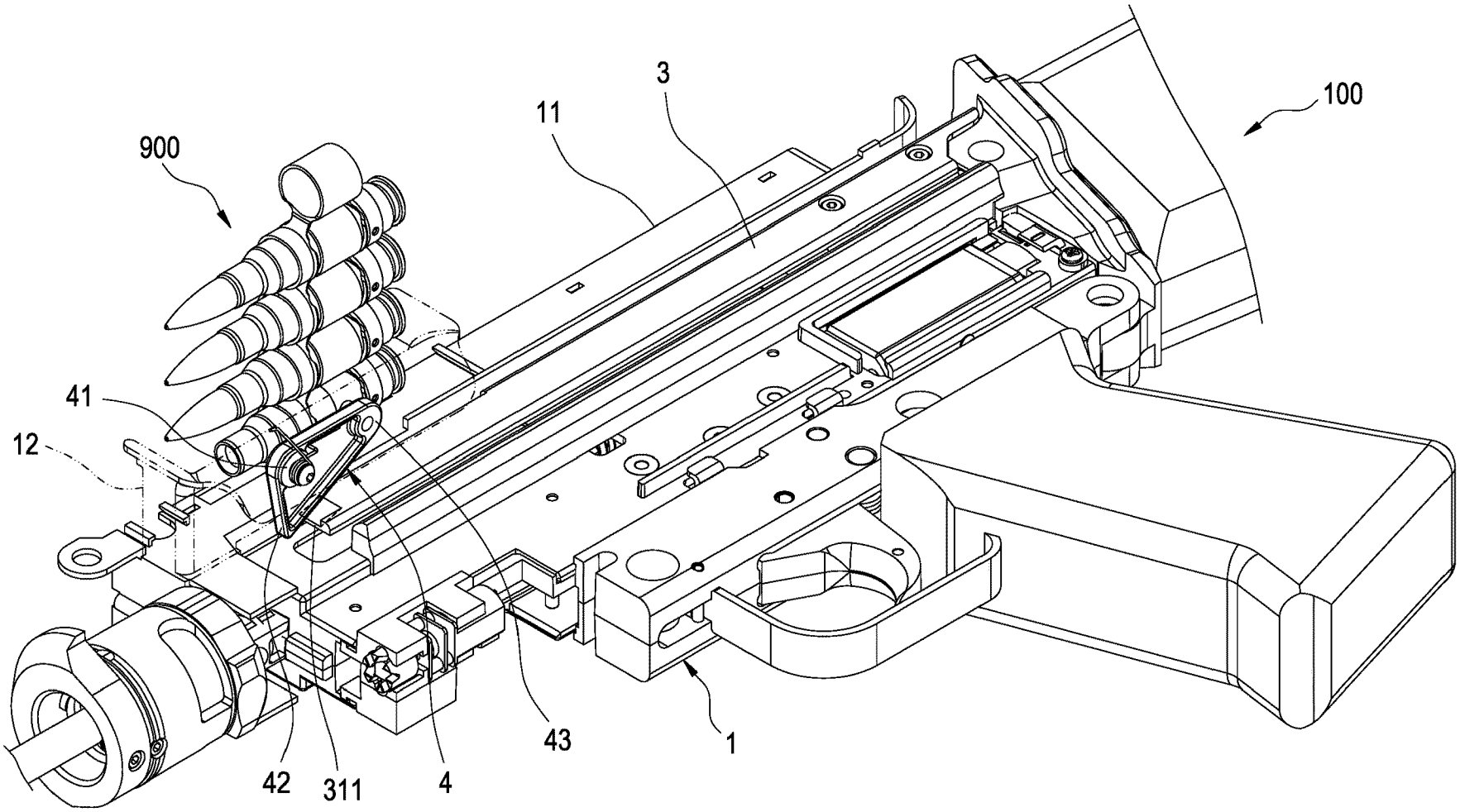
FIG. 5 is a perspective view of a toy gun of this disclosure.

Specifically, in FIGS. 3 and 5, the moving main body 31 includes a first component 31*a* and a second component 31*b* combined parallel to each other, and the first component 31*a* has an arm (not labelled) extended along the reciprocating direction of the reciprocating assembly 3, and the trigger portion 311 is formed at an extended end of the arm.

The actuated member 4 is provided for triggering the trigger portion 311 to produce the corresponding action to link the bullet chain 900 to shake. However, the structure of the actuated member 4 of this disclosure is not limited specifically, and it may be a frame or an elastic frame as shown in the figure, or it may also be an elastic body which is not shown in the figure.

When the actuated member 4 is the elastic body (such as an elastic arm), a part of the actuated member 4 (such as an end of the elastic arm) is fixed to the gun body 1, and the other part of the actuated member 4 (such as the other end of the elastic arm) is connected to the bullet chain 900, and the actuated member 4 is located on the moving path S. Therefore, when the trigger portion 311 reciprocates to trigger the actuated member 4 (such as triggering a position between two ends of the elastic arm), the actuated member 4 itself may produce a corresponding reciprocating elastic bending action, and the actuated member 4 links the bullet chain 900 to shake according to the reciprocating elastic bending action.

When the actuated member 4 is a frame or an elastic frame, the actuated member 4 is rotatably installed to the gun body 1 and located on the moving path S as shown in FIGS. 2, 5, 7 and 8, and the actuated member 4 is connected to the bullet chain 900. Therefore, as shown in FIGS. 7 to 10, when the trigger portion 311 reciprocates to trigger the actuated member 4, the actuated member 4 itself may produce a corresponding deflection (such as an eccentric rotation), and the actuated member 4 links the bullet chain 900 to shake according to such deflection, and the details are described as follows.

Figure 10:
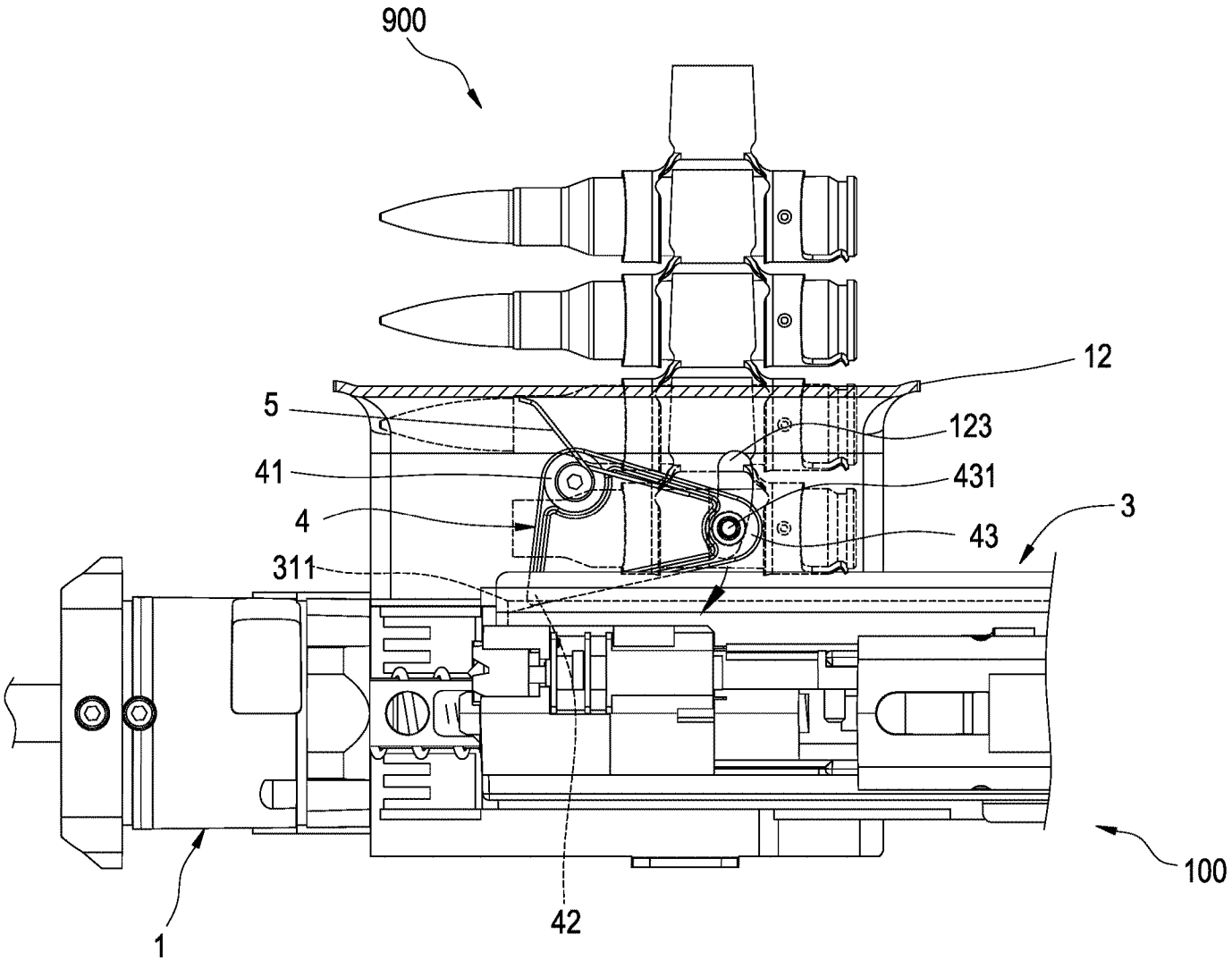
FIG. 10 is a bottom view of FIG. 9.

In FIGS. 8 and 10, the actuated member 4 has a connecting portion 41 and a passive portion 42, and in some embodiments, further has a linking portion 43. The connecting portion 41 is rotatably connected to the gun body 1, so that the actuated member 4 may use the connecting portion 41 as a deflection center and has at least one eccentric position. For example, the actuated member 4 has a first eccentric position P1, and in some embodiments, further has a second eccentric position P2, so that the connecting portion 41, the passive portion 42 and the linking portion 43 are configured into a triangular shape. The first eccentric position P1 is located on the moving path S, and the passive portion 42 is located at the first eccentric position P1. In some embodiments, the linking portion 43 is located at the second eccentric position P2.

Therefore, when the trigger portion 311 reciprocates with the reciprocating assembly 3 on the moving path S, the passive portion 42 located at the first eccentric position P1 is triggered, so that the actuated member 4 not only uses the connecting portion 41 as the deflection center to produce the corresponding deflection action, but also drives the linking portion 43 to deflect accordingly, and the actuated member 4 links the bullet chain 900 to shake according to such deflection.

In FIGS. 2, 8 and 10, this disclosure further includes a passive elastic element 5 elastically supported between the actuated member 4 and the gun body 1 for elastically driving the actuated member 4 to return to the original position after the deflection. The passive elastic element 5 includes, but not limited to, a torsion spring, and the torsion spring sheathes the connecting portion 41 and is elastically supported between the actuated member 4 and the gun body 1.

In this way, after a user pulls the trigger, the reciprocating assembly 3 is linked to reciprocate, and the actuated member 4 is also triggered by the trigger portion 311 of the reciprocating assembly 3 to deflect, and the actuated member 4 may link the bullet chain 900 to shake according to such deflection. In other words, the bullet chain 900 is linked to shake by triggering the actuated member 4 to deflect, so that when the user pulls the trigger, the bullet chain 900 is linked to simulate the vibration of a real gun with a high degree of simulation.

In FIGS. 1, 2, 5, 7 and 8, the gun body 1 may further have an ammunition feed bracket 12 for supporting the bullet chain 900 at an ammunition feed position (not shown in the figure), and the ammunition feed bracket 12 may be placed on a side of the gun body 1 by hanging on the gun body upper frame 11.

Figure 7:
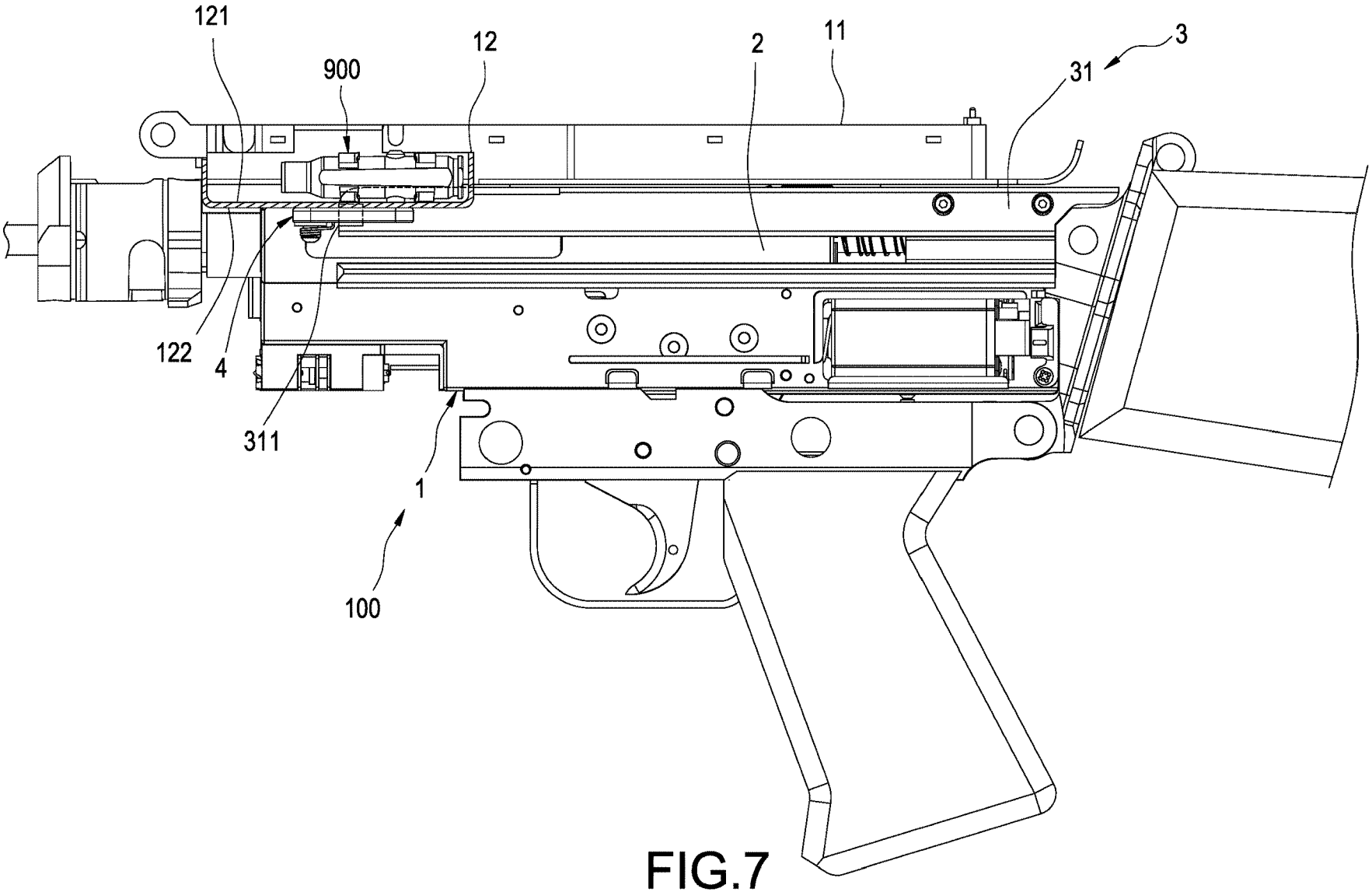
FIG. 7 is a partial cross-sectional view of an ammunition feed bracket of a toy gun of this disclosure (before the toy gun is triggered)

Specifically, the ammunition feed bracket 12 as shown in FIG. 7 has one side 121 and another side 122 opposite to each other, and the ammunition feed bracket 12 as shown in FIGS. 2 and 8 further has a guide slot 123 communicating between the one side 121 and the other side 122. The bullet chain 900 and the actuated member 4 are disposed on the one side 121 and the other side 122 respectively. The bullet chain 900 is carried on the one side 121 and has a through hole 9 as shown in FIGS. 2 and 8, and the connecting portion 41 of the actuated member 4 is rotatably connected to the ammunition feed bracket 12, and the linking portion 43 of the actuated member 4 as shown in FIGS. 2 and 8 has a stud 431, and the stud 431 passes through the guide slot 123 and is then rotatably inserted into the through hole 9.

In this way, when the actuated member 4 is reciprocatingly deflected, the stud 431 reciprocates between the two ends of the guide slot 123 and links the bullet chain 900 to shake as shown in FIGS. 8 and 10.

In summation of the description above, the simulated shaking bullet chain type toy gun of this disclosure may achieve the expected effects and overcome the drawbacks of the related art.

While this disclosure has been described by means of specific embodiments, numerous modifications and variations could be made thereto by those skilled in the art without departing from the scope and spirit of this disclosure set forth in the claims.

What is claimed is:

1. A toy gun, equipped with a bullet chain and comprising:
- a gun body;
- a bolt assembly, reciprocatingly disposed in the gun body;
- a reciprocating assembly, reciprocatingly disposed in the gun body and linked with the bolt assembly, and comprising a trigger portion reciprocating with the reciprocating assembly to produce a moving path; and
- an actuated member, installed on the gun body and located on the moving path, and coupled to the bullet chain;
- wherein, the reciprocating assembly is configured to reciprocate to trigger the actuated member by the trigger portion, and the actuated member is configured to link the bullet chain to shake,
- the gun body is equipped with an ammunition feed bracket, and the actuated member is rotatably coupled to the ammunition feed bracket and comprises a linking portion, and the ammunition feed bracket carries the bullet chain, and the actuated member is rotatably coupled to the bullet chain by the linking portion.

2. The toy gun according to claim 1, wherein the actuated member comprises an elastic body.

3. The toy gun according to claim 1, wherein the actuated member is rotatably coupled to the gun body, and the trigger portion triggers the actuated member to deflect relative to the gun body.

4. The toy gun according to claim 3, further comprising: a passive elastic element, elastically supported between the actuated member and the gun body.

5. The toy gun according to claim 3, wherein the actuated member comprises a connecting portion, a passive portion and a linking portion configured in a triangular shape, and the actuated member is rotatably coupled to the gun body by the connecting portion, and the trigger portion triggers the passive portion, and the linking portion is coupled to the bullet chain.

6. The toy gun according to claim 5, wherein the actuated member comprises an elastic frame.

7. The toy gun according to claim 1, further comprising: a passive elastic element, elastically supported between the actuated member and the gun body.

8. The toy gun according to claim 1, wherein the ammunition feed bracket comprises two sides opposite to each other and a guide slot disposed thereon communicating the two sides, and the actuated member and the bullet chain are respectively disposed on the two sides, and the linking portion passes through the guide slot and is coupled to the bullet chain.

9. A toy gun, equipped with a bullet chain and comprising:

a gun body;

a bolt assembly, reciprocatingly disposed in the gun body;

a reciprocating assembly, reciprocatingly disposed in the gun body and linked with the bolt assembly, and comprising a trigger portion reciprocating with the reciprocating assembly to produce a moving path; and an actuated member, installed on the gun body and located on the moving path, and coupled to the bullet chain;

wherein, the reciprocating assembly is configured to reciprocate to trigger the actuated member by the trigger portion, and the actuated member is configured to link the bullet chain to shake, wherein the actuated member comprises a connecting portion and a passive portion, and the connecting portion is rotatably coupled to the gun body, and the connecting portion is as a deflection center of the actuated member and at least one eccentric position of the actuated member is located on the moving path, and the passive portion is located at the eccentric position.

10. The toy gun according to claim 9, wherein the eccentric position comprises a first eccentric position and a second eccentric position, and the actuated member further comprises a linking portion, and the passive portion is located at the first eccentric position, and the linking portion is located at the second eccentric position, and the first eccentric position is located on the moving path.

11. A toy gun, equipped with a bullet chain and comprising:

a gun body;

a bolt assembly, reciprocatingly disposed in the gun body;

a reciprocating assembly, reciprocatingly disposed in the gun body and linked with the bolt assembly, and comprising a trigger portion reciprocating with the reciprocating assembly to produce a moving path; and an actuated member, installed on the gun body and located on the moving path, and coupled to the bullet chain;

wherein, the reciprocating assembly is configured to reciprocate to trigger the actuated member by the trigger portion, and the actuated member is configured to link the bullet chain to shake, the reciprocating assembly comprises a moving main body, an actuating rod, a first actuating elastic element and a second actuating elastic element, and the moving main body is slidably coupled to the gun body and comprises a fixing portion, and the actuating rod comprises a fixing section disposed on one end thereof, and another end of the actuating rod is inserted in one end of the bolt assembly, and the fixing section is fixed to the fixing portion and partially exposed, and the first actuating elastic element is adapted to sheathe the fixing section on a location partially exposed and is elastically supported between the moving main body and the gun body, and the second actuating elastic element is adapted to sheathe the actuating rod and is elastically supported between the moving main body and the one end of the bolt assembly.

* * * * *